US006085988A

United States Patent [19]

Marsh

[11] Patent Number: 6,085,988

[45] Date of Patent: Jul. 11, 2000

[54] LAMINAR FLOW VERTICAL JET STREAM NOZZLE WITH OVERHEAD STREAM CAPTURE

[76] Inventor: Guy A. Marsh, 475 E. Cedar St., Farmington, N. Mex. 87401

[21] Appl. No.: 09/193,138

[22] Filed: Nov. 17, 1998

[51] Int. Cl.[7] ..... B05B 17/08

[52] U.S. Cl. ..... 239/17; 239/20; 239/499; 239/518; 239/524

[58] Field of Search ..... 239/16, 17, 18, 239/20, 499, 518, 524

[56] References Cited

U.S. PATENT DOCUMENTS

| | | | |
|---|---|---|---|
| 3,151,811 | 10/1964 | Hruby, Jr. | 239/20 |
| 3,785,559 | 1/1974 | Hruby, Jr. | 239/17 |
| 4,205,785 | 6/1980 | Stanley | 239/17 |
| 4,889,283 | 12/1989 | Fuller et al. | 239/17 X |
| 4,892,256 | 1/1990 | Brown et al. | 239/524 X |
| 4,901,922 | 2/1990 | Kessener et al. | 239/18 X |
| 5,160,086 | 11/1992 | Kuykendal et al. | 239/18 |

*Primary Examiner*—Lesley D. Morris
*Attorney, Agent, or Firm*—Maxwell C. Freudenberg; Kenton L. Freudenberg

[57] ABSTRACT

A laminar flow liquid stream nozzle having capability of being mounted to project a stream in any direction including directly overhead and including a stream capturing device for making the stream seem to disappear when projected overhead. The nozzle is selectively capable of momentary stream bursts or timed periods of projection from short periods to continuous stream flow. A structure of multiple such nozzles is provided having at least two banks of oppositely located spaced receptacles with essentially linear laminar flow stream patterns each projected unidirectionally from a nozzle in one receptacle to a receiver in another receptacle. The structure may include vertical linear stream patterns. These patterns may include parallel laminar jet streams and some may be projected straight up. Turning a vertically directed stream "off" may be achieved by a splitting water spray which causes split stream portions to be intercepted by surfaces within the nozzle near the normal "on" laminar flow stream path. Drip guides are provided on the intercepting surfaces to prevent residual or collected water droplets existing on these surfaces during "on" periods from falling into the path of and disturbing the appearance of the "on" laminar stream.

21 Claims, 10 Drawing Sheets

LAMINAR FLOW VERTICAL JET STREAM NOZZLE WITH OVERHEAD STREAM CAPTURE

This invention relates to jet stream nozzle apparatus for generating and projecting a selectively and intermittently interruptable glass-rod-like laminar flow water stream in any direction from a projection point to a receiving point. These points may be vertically spaced and in different mutually spaced structures. Continuous or intermittent sections of the laminar stream have an appearance similar to a smooth glass rod.

BACKGROUND OF THE INVENTION

Several devices for projecting an inclined laminar stream in a direction outwardly and upwardly at substantial angles from both the vertical and horizontal directions are shown and described in the following patents: U.S. Pat. No. 3,630,444 (FIG. 6), U.S. Pat. Nos. 4,795,092, 4,889,283, 4,995,540, and 5,160,086. In these devices no part of a projected laminar flow stream flows directly vertically either up or down and no part of a stream returns to the vicinity of the nozzle orifice from which it issues and thus pose no interfere problem with a subsequent U.S. Pat. No. 4,889,283 controllably interrupts the projection of the stream by splitting it with a flat knife-like spray of water to divert the stream portions to inverted catch basins on opposite sides of the normal projected stream path. Another patent U.S. Pat. No. 5,161,740 shows and describes a "pop jet" type fountain device for projecting vertically from a laminar flow producing orifice momentary bursts of water which flow through a secondary pool to pick up additional water and air bubbles to form "amoeba" shaped surface-tension envelopes or "balls" of water which for vertical projection presumably, though not described, completes an up and return "cycle" before the next "ball" of water is shot up. Otherwise the returning water would interfere with the ensuing upward projection. U.S. Pat. No. 3,151,811 shows a non-laminar flow conical fountain projecting multiple divergent spray portions upwardly into an area where they move outwardly and fall by gravity into an elevated annular trough.

SUMMARY OF THE INVENTION

The present laminar jet stream system is capable of being arranged to project a laminar jet stream either continuously or programmably intermittently in any direction including directly vertically up or down.

In describing the present invention the term jet stream is intended to refer to a conspicuously observable continuous or intermittent laminar flow stream of water having an essentially round cross section and a smooth appearance like that of a smooth glass rod. The round or rod-like configuration is determined by a round discharge orifice from a pressurized non-turbulent laminar flowing water body and by surface tension of the water. The effects of gravity come into play to slightly change the round cross section essentially only for projection which is not straight up or down. Slow moving or stagnant droplets and other residual water in the system may be referred to as spent or low energy liquid as distinguished from the relatively faster high energy liquid in the laminar flow jet streams and the splitting sprays.

It is an object of the present invention to provide a laminar flow jet stream system in which a nozzle structure can be arranged to project a continuous or intermittent jet stream in any direction.

Another object of the present invention is to provide a jet stream nozzle system in which the direction of projection of a jet stream can be selectively changed from vertically upward to vertically downward.

Another object of the invention is to provide a jet stream system in which vertical upward projection of a jet stream can be maintained independently of duration of the jet stream flow.

Another object of the invention is to provide an improved diverter system for selectively diverting the flow of a laminar stream in a nozzle device before it is projected as an external jet stream.

Another object of the present invention is to prevent drops of water collecting on portions of the diverter system during operation of the nozzle device from dropping by gravity into the path of and disfiguring a laminar flow jet stream of water being projected.

Another object of the present invention is to prevent drops of water collecting on portions of the diverter system during operation of the nozzle device from dropping by gravity to interfere with the smooth appearance of a laminar flow jet stream of water being projected.

A further object of the invention is to achieve a laminar flow nozzle system having an eye-catching effect utilizing multiple jet streams which are projected straight and seem to disappear.

The present invention has the capability of projecting a laminar jet stream in any direction. When projected straight up the stream can be captured by means forming part of the invention so as not to disruptively fall back into itself. The outside of the diverter against which split stream portions are directed has a curved flare and has drip guides on its outer surface near its lower curved entry end to prevent droplets on the outer side of the diverter from falling into a jet stream flowing through the diverter. The present inventor has used as prior art a straight sided diverter cone with no means for drip control.

DESCRIPTION OF THE PREFERRED EMBODIMENT

Figure 1:
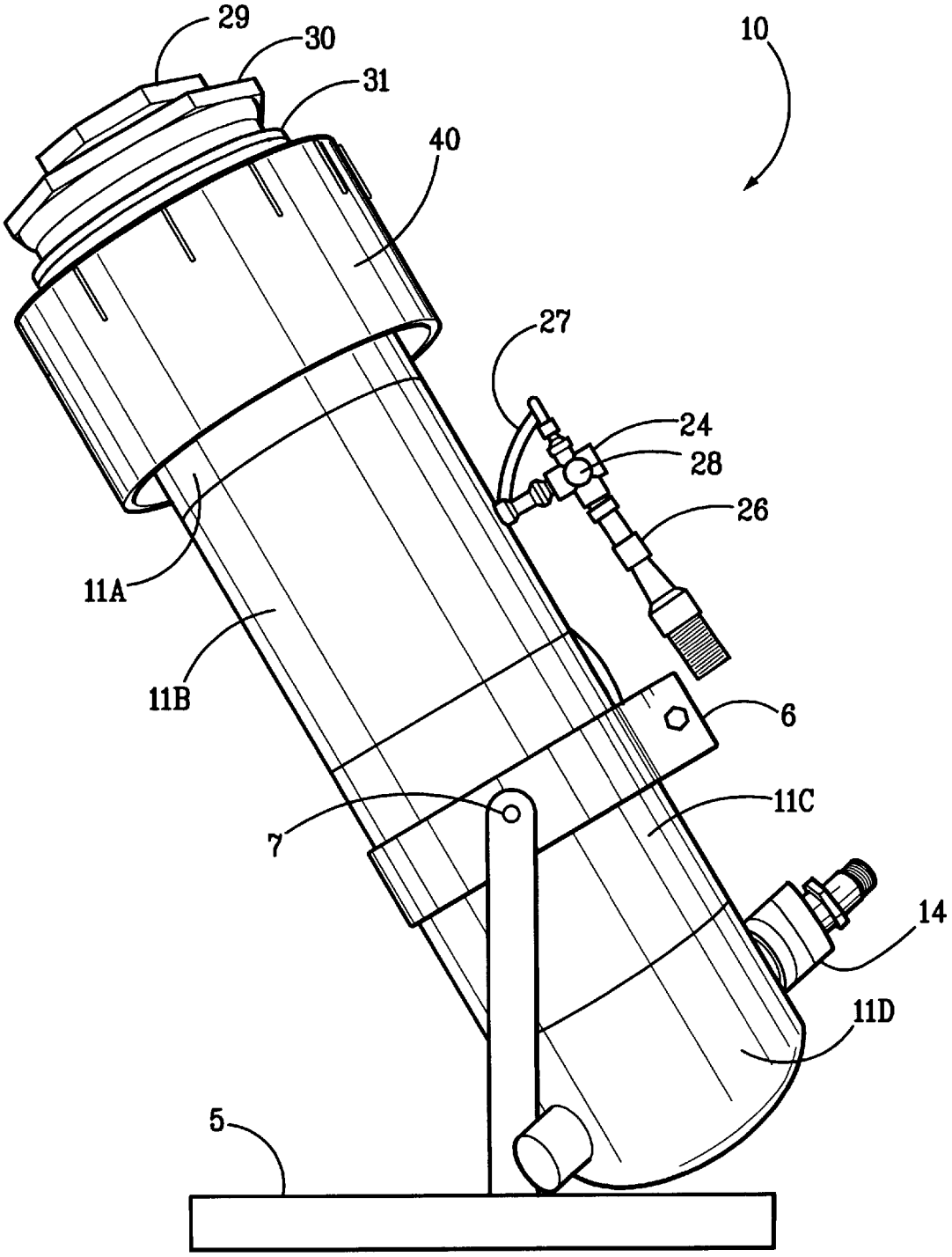
FIG. 1 is a side view of a nozzle device according to the present invention pivotably mounted at an inclined angle on a adjustable pivot supporting frame.

A nozzle device 10 for projecting a laminar flow jet stream is shown in FIG. 1 adjustably pivotably mounted at an angle of 60° to the horizontal by means of a stationary frame support 5 carrying a pivotable frame member 6 clamped to the casing of nozzle 10. The pivotable frame member 6 is adjustably clamped by suitable means (not shown) to the stationary frame support 5 to enable the nozzle to be adjusted to any desired position of use from straight up to straight down. The lower portion of the nozzle can be swung clockwise down about the pivot axis 7 within the frame 5 to point the nozzle straight up. By properly configuring the frame 5 for no interference with the nozzle the upper end of the nozzle 10 can be swung 150° counterclockwise from the FIG. 1 position to point straight down. In such swinging movements the splitting nozzle and its valve 24 remain at the top side of the nozzle device casing because there are several drain openings 53 and 55 in the other side of the nozzle casing which should preferably be kept at the lower side of the casing.

Figure 2:
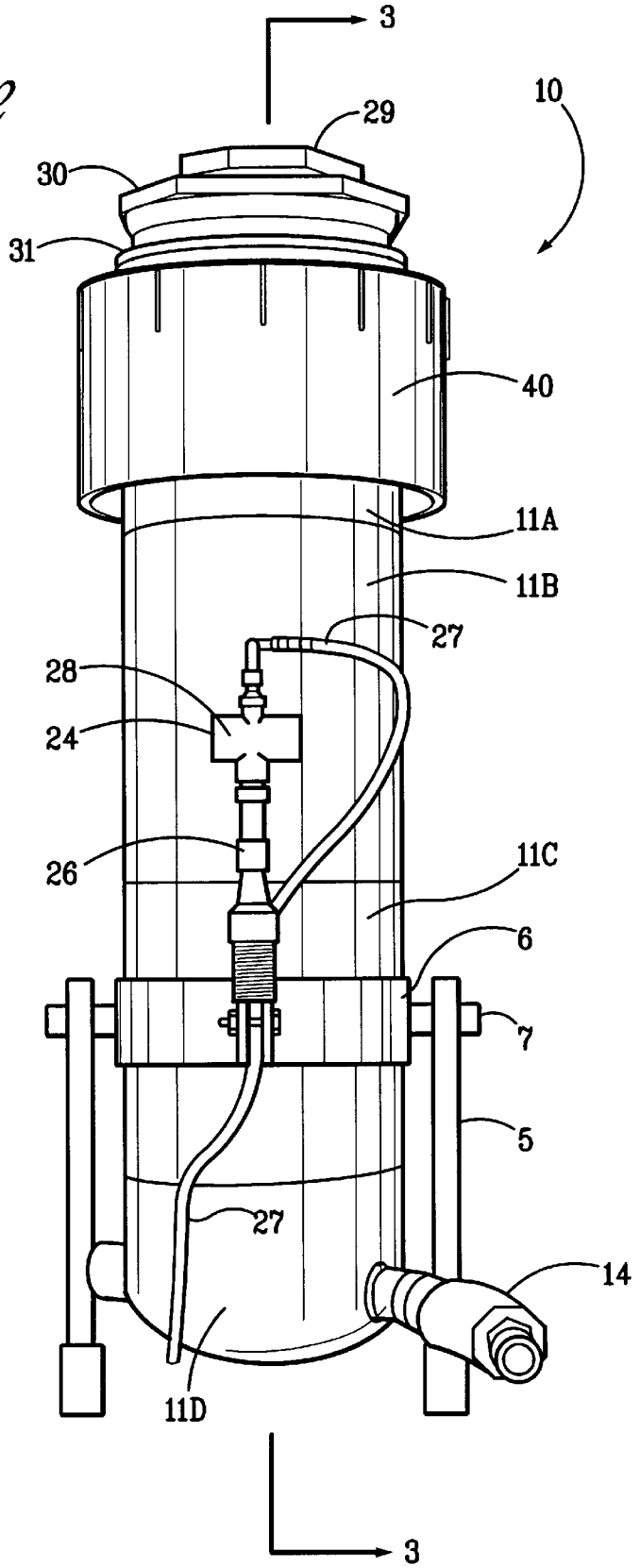
FIG. 2 is a view from the right side of the nozzle device of FIG. 1.
Figure 3:
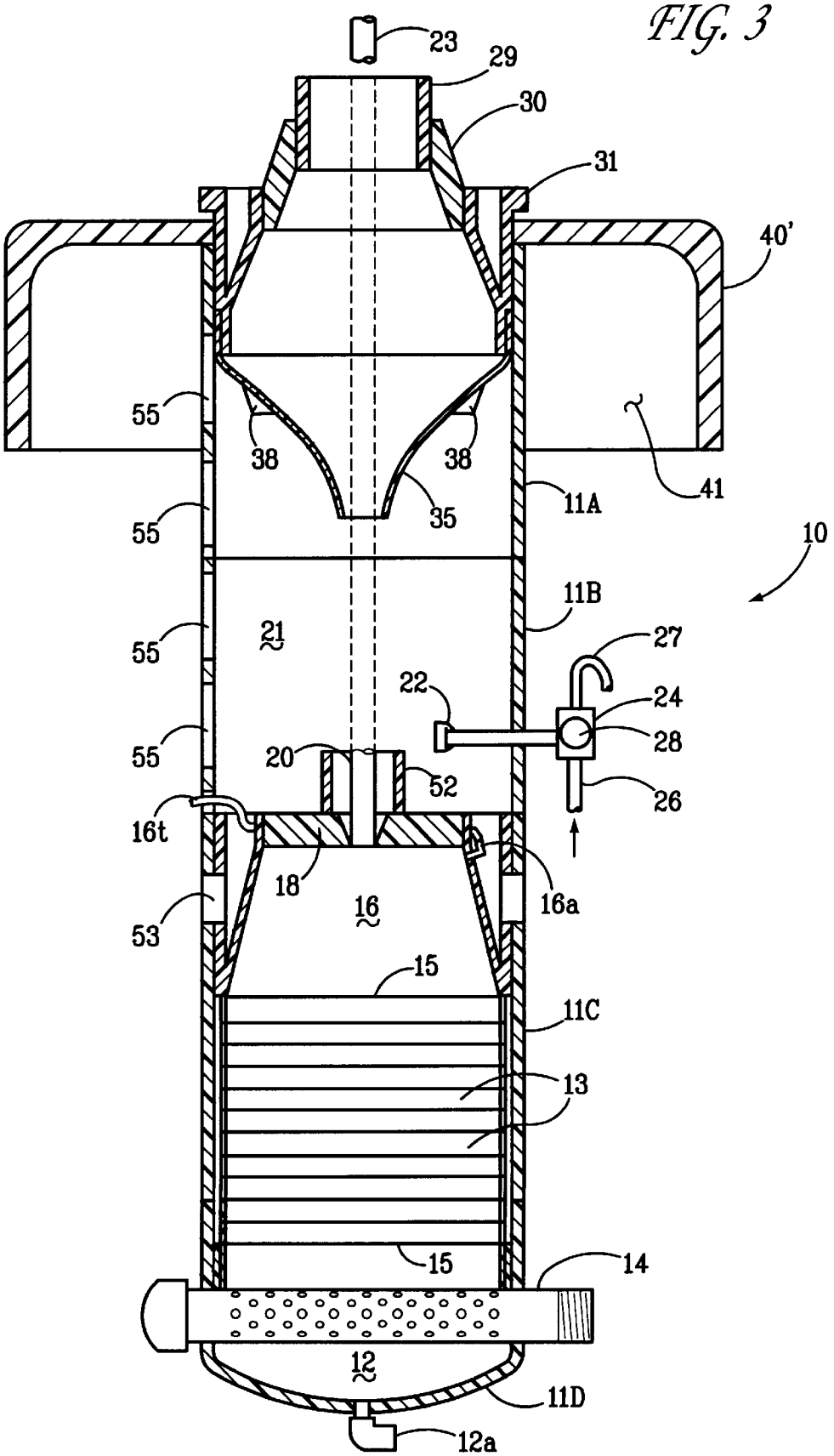
FIG. 3 is a section of the nozzle device taken on the vertical centerplane line 3—3 of FIG. 2 and showing a conical jet stream interceptor and diverter, but with an annular shield larger than in FIGS. 1–2.

As seen in FIGS. 1–3 the nozzle device 10 comprises an elongated cylindrical PVC canister or casing of generally round cross section and formed by several like-diameter cylindrical portions 11A, 11B and 11C connected end-to-end and to an inverted dome-like or cup member 11D at the lower end. A first or lower end portion of the nozzle device formed by the cup member 11D contains an input chamber 12 which is supplied with water from a continuously pumped pressurized source (not shown) including a reservoir tank for collected recirculating water from nozzle operation and having water level control for admitting additional water as needed from a typical main through a conventional water softening and demineralizing unit. The pressurized source includes a pump for pumping water from the tank to an inlet end of pipe 14 which extends into and diametrically across the input chamber 12. The other end of pipe 14 is capped. The pipe 14 is uniformly perforated on all sides along the entire portion within the chamber 12 to provide good distribution of water across the input chamber 12 as a first step in reducing turbulence of water flowing through the nozzle 10. The pressurized water is forced from chamber 12 through a stacked arrangement of turbulence reducing pad-like disk members 13 held between stationary rigid non-air-trapping perforated thin stainless steel plates 15 at opposite ends of the stack. The pads 13 are ½ inch thick and are made of a random pattern of overlapping vinyl loops of small diameter which form a multitude of free-flowing convoluted passages through the pads 13. After passing through the stacked pads 13 the water reaches a laminar flow state in a chamber 16 where upon flowing through a round sharp edged orifice at the center of the lower face of a jet forming plate 18 it is formed into an essentially turbulent free laminar flow stream 20 having the appearance of a glass-like rod and projected coaxially of the nozzle device axially into or through a splitting or diverting chamber 21.

To eliminate air in chamber 16 when the nozzle device points up as in FIGS. 1–3 an air bleed connector 16*a* at the top of chamber 16 allows the escape of trapped air. The connector has an outlet tube 16*t* for discharging water and air to the other side of the nozzle device. Similarly when the nozzle device is inverted to point down, another such air bleed connector 12*a* is connected to a central high point of the inlet chamber 12.

Unless acted upon by a splitting spray from nozzle 22 in chamber 21, the stream 20 continues axially of the nozzle device 10 from which it emerges as a laminar flow jet stream 23 from a coaxial sleeve 29 at the upper or second end of the nozzle device 10 with sufficient velocity to perform attractive and pleasing display actions as described hereinafter. The sleeve 29 is anchored in the upper end of a cylindrical casing portion 11A by size reducing adapters 30 and 31. The 7/16 inch diameter of the orifice in plate 18 together with the flow rate and pressure of water supplied to the inlet pipe 14 determine the path of jet stream 23. This path and the laminar flow character are also affected by gravity and the direction in which the nozzle device is pointed.

When any stray spray or residual drops of water move down the inside of the nozzle device 10 and onto the upper surface of the jet stream forming plate 18, such moisture is kept from flowing into the diverging or conical aperture above the sharp edge at the stream forming aperture by a dam 52 which retains or guides any water on the top of plate 18 to drain off through a hole 53 in a side wall or casing portion of the nozzle 10.

Figure 3A:
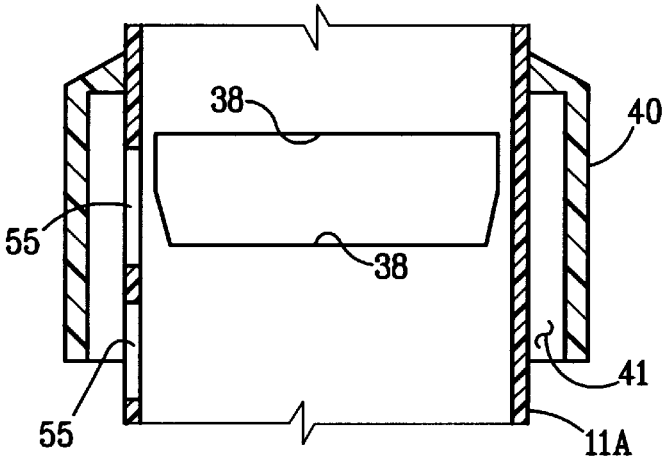
FIG. 3A is a section of part of the nozzle device of FIG. 1 and similar to FIG. 3 with the conical split stream interceptor omitted showing a complete exit window for escape of a diverted split stream portion.
Figure 3B:
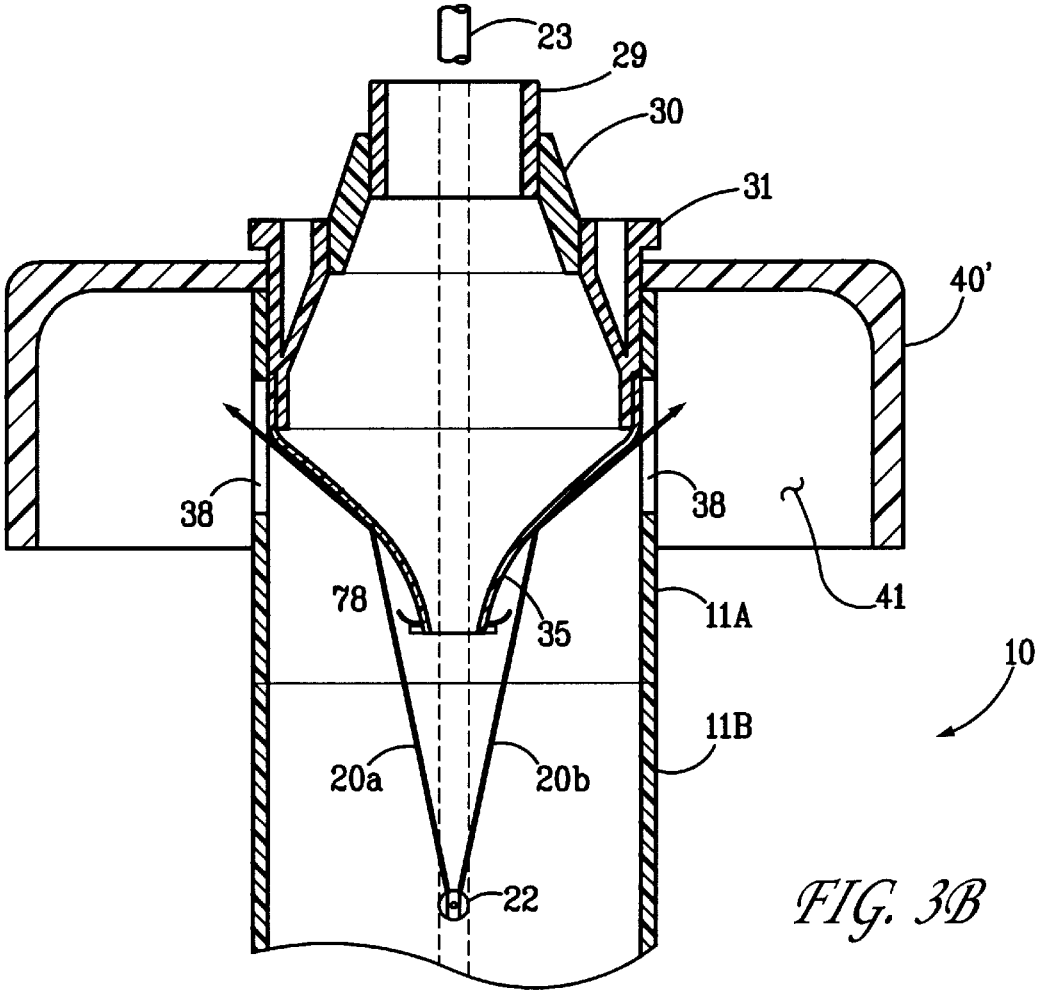
FIG. 3B is a section view of part of the nozzle device of FIG. 3, but taken on a plane perpendicular to that of FIG. 3 and containing the nozzle device axis and looking at the splitting nozzle to show the respective liquid paths after the jet stream is split with the deflected split stream portions moving outwardly through respective exit windows.

The spray from splitting nozzle 22 is preferably a flat knife-like spray of water projected in a plane containing the axis of the stream 20 and capable of splitting the stream 20 into two portions 20A and 20B as seen in FIG. 3B which move past the drip guide 78 on the lower end of the conical diverter 35 and move upwardly and outwardly along the upper sides of the diverter. The splitting spray from nozzle 22 is actuated by a fast-acting solenoid operated valve 24 having a pressurized water inlet line 26 connected to the sane pressurized water source (not shown) which feeds the inlet pipe 14 for the nozzle device 10. The valve 24 has a normally-open discharge to the splitting nozzle 22 which keeps the laminar jet stream split or "off" when the solenoid 28 is not energized. Energization of the solenoid 28 actuates the valve 24 by means of which all water through the valve 24 flows to a bypass connection 27 and the pressurized splitting water supply bypasses the splitting nozzle 22 and is returned to the aforementioned water tank for recirculation. Any suitable control mechanism may the valve to stop supply of splitting spray from nozzle 22 momentarily, for different timed periods or continuously to cause the stream 20 to be projected for respective periods of time producing short bullets of flow, longer variable length rods of flow or a continuous rod-like laminar flow stream flowing between the nozzle 10 to any appropriate receiver or destination point.

When the stream 20 is split as seen in FIG. 3B, the portion 20A is directed to the left in FIG. 3B and away from the reader in FIG. 3 to move in spaced relationship past an open relatively pointed lower or entry end of a cone-like interceptor diverter 35 and upon striking the outer surface of the diverter 35 be directed upwardly and outwardly along the surface of the diverter and then through a respective arcuate window 38 at one side of the nozzle 10. Similarly the other split portion 20B strikes the other side of the cone-like diverter 35 and is directed through the opposite arcuate window 38. Each of the windows extends about 125° around a cylindrical wall portion 11A of the nozzle device 10. As seen in FIG. 3A, an annular shield 40 (of FIGS. 1 and 2) intercepts the outwardly directed split streams 20A and 20B. Upon striking the shield 40, or the larger diameter shield 40' in the embodiment of FIGS. 3 and 3B, the water of streams 20A and 20B falls from the bottom of the chamber or space 41 between the wall portion 11A and the shield 40 or 40' and can exit this chamber to be conducted by any suitable means back to the aforementioned tank for supply to the pressurized water source for recirculation. The shield 40' of FIGS. 3 and 3B surrounding wall portion 11A, is of less height, and of greater diameter than the shield 40 illustrated in FIGS. 1, 2 and 3A. This is advantageous for vertical stream projection of several feet where the amount and velocity of diverted or split water may be increased.

Figure 4B:
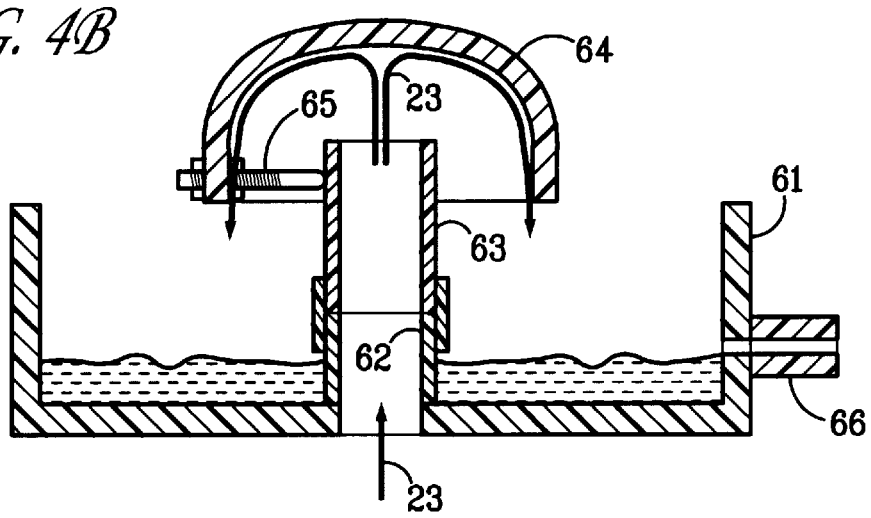
FIG. 4B is a partial vertical section and shows in section the orientation above the nozzle device of a cooperating catching, diverting and retaining device to be fixed above the exit portion of the nozzle device of FIG. 4A for capturing a vertically projected jet stream.
Figure 4A:
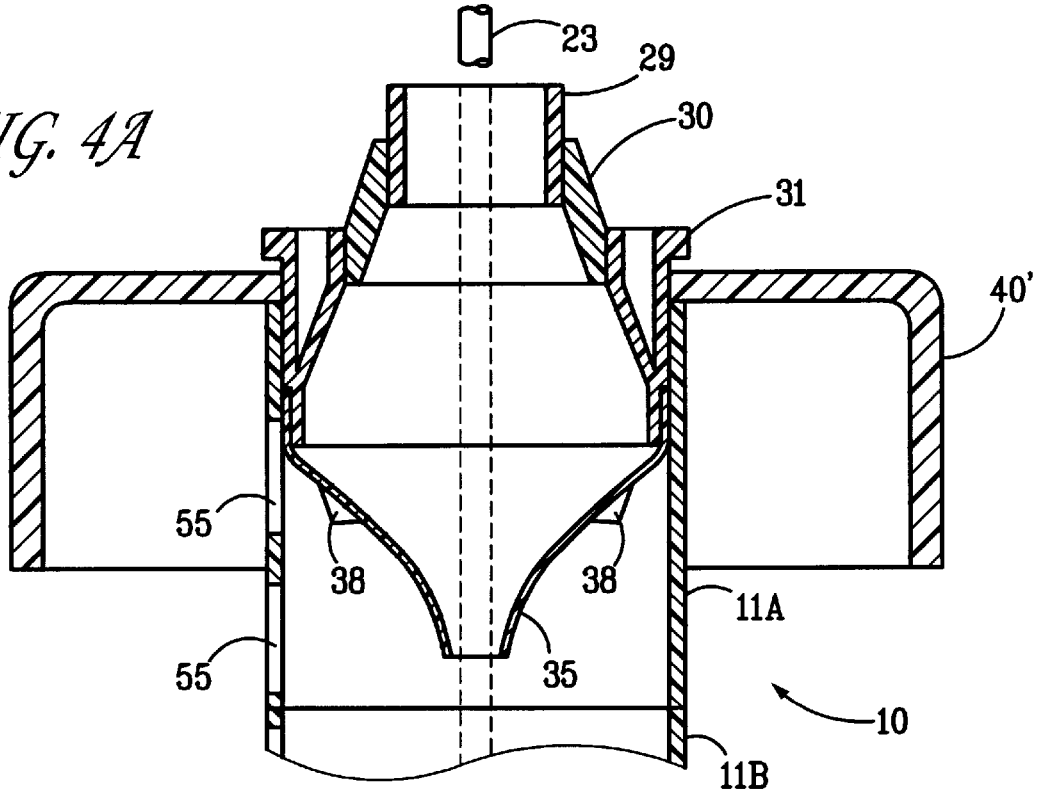
FIG. 4A is a partial vertical section of a preferred embodiment of the invention which incorporates a system for vertical upward projection of a jet stream using a nozzle device like that of FIGS. 1–3, but vertically oriented and for simplicity showing in section, taken along the axis of the device like the view of FIG. 3 and showing only the upper stream exit portion of the nozzle device above a point of jet stream splitting.

Above the nozzle device 10 as oriented in FIG. 4A for vertical projection of the jet stream 23, the stream 23 disappears by being captured within a cooperating relatively fixed catching, diverting and retaining device 60 seen in FIG. 4B. This capturing device 60 includes a trough 61 supported by any suitable means in fixed relationship to the nozzle device 10 and having at an aperture in the bottom surface of the trough 61 an upstanding vertical cylindrical sleeve or dam 62 fixed and sealed therein and coaxially aligned with the nozzle device 10 to receive the stream 23. Removably supported coaxially on the sleeve 62 is a taller cylindrical sleeve 63 which carries and extends into an inverted coaxial cup-shaped or dome-shaped member 64. The member 64 is positioned and supported on the upper end of sleeve 63 by three uniformly spaced and angularly related screws 65 with the center of member 64 horizontal and generally perpendicular to the axis of the nozzle device 10 and the stream 23. The capturing device 60 is fixed by suitable means, i.e. as in FIG. 13, at a height above the nozzle device 10 such that the stream 23 is still a laminarly flowing stream and has sufficient energy that it will be deflected outwardly upon striking the center of the member 64 and flow along its inner surface to its outer depending walls where it is further deflected downwardly into the trough 61 and prevented from dropping back through the sleeve 63 and possibly interfering with the upward laminar flow of the stream 23. When the stream 23 is interrupted, any residual drops of water on the inner surface of member 64 similarly run down its outer walls and drip into the trough 61. Spent water from the stream 23 is returned for recirculation by any suitable means from a drain connection 66 at the bottom of trough 61 to the aforementioned tank of the pressurized source for the nozzle 10 system.

Figure 5:
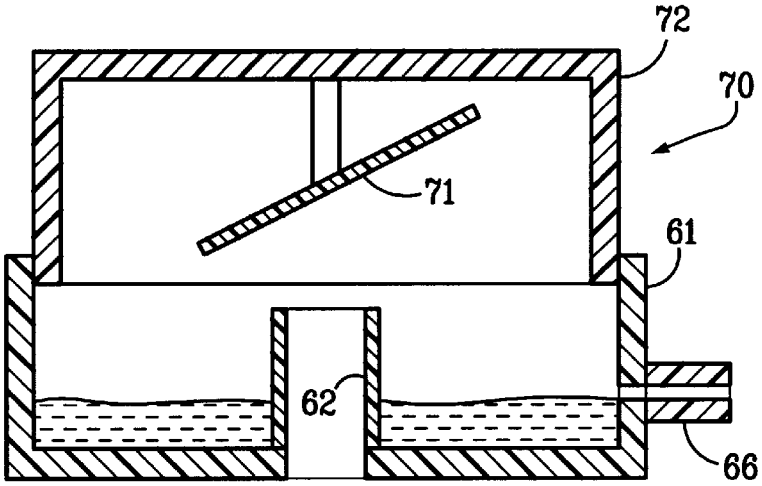
FIG. 5 is a vertical section in the same axial plane corresponding to FIG. 4B of an alternative embodiment of a jet stream catching, diverting and retaining device.

FIG. 5 shows a jet stream capturing device 70 alternative to the capturing device 60 shown in FIG. 4. This capturing device 70 includes a trough 61 supported by any suitable means in fixed relationship to the nozzle device 10 and having at an aperture in the bottom surface of the trough 61 an upstanding vertical cylindrical sleeve 62 fixed and sealed therein and coaxially aligned with the nozzle device 10 to receive the stream 23. In lieu of the cup 64 of FIG. 4, this embodiment has a flat inclined plate 71 extending in all horizontal directions past the vertical sleeve 62. A jet stream striking this plate is deflected outwardly to the walls of a box 72 which provides means to support the plate on the trough 61 and diverted water of the jet stream drains into the trough 61. Any residual drops on the plate 71 after the stream 23 stops flowing merely flow down the lower face of the plate 71 where they drip off the lower edge of the plate into the trough 61.

Figure 6:
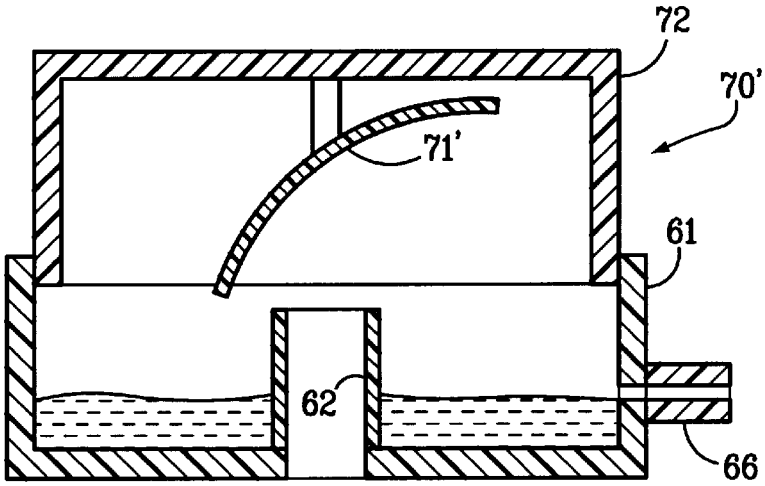
FIG. 6 is a vertical section in the same axial plane corresponding to FIG. 4B of another alternative embodiment of a jet stream catching, diverting and retaining device.

FIG. 6 shows a jet stream capturing device 70' alternative to the capturing device 60 shown in FIG. 4 and mounted like the device 70 of FIG. 5. This capturing device 70' includes a trough 61 supported by any suitable means in fixed relationship to the nozzle device 10 and having at an aperture in the bottom surface of the trough 61 an upstanding vertical cylindrical sleeve 62 fixed and sealed therein and coaxially aligned with the nozzle device 10 to receive the stream 23. In lieu of the cup 64 of FIG. 4, this embodiment has a relatively flat inclined plate 71' with a concave lower surface which extends in all horizontal directions past the vertical sleeve 62. A jet stream striking this plate is deflected outwardly to the walls of the box 72 which provides means to support the downwardly concave plate 71' on the trough 61 and diverted water of the jet stream drains into the trough 61. Any residual drops on the plate 71' after the stream 23 stops flowing merely flow down the lower face of the plate 71 where they drip off the lower edge of the plate into the trough 61.

Figure 7:
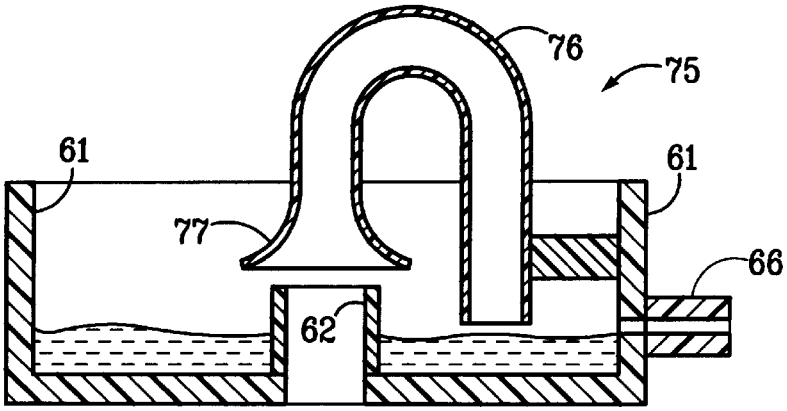
FIG. 7 is a vertical section in the same axial plane corresponding to FIG. 4B of still another alternative embodiment of a jet stream catching, diverting and retaining device.

FIG. 7 shows a jet stream capturing device 75 alternative to the capturing device 60 shown in FIG. 4. This capturing device 75 includes a trough 61 supported by any suitable means in fixed relationship to the nozzle device 10 and having at an aperture in the bottom surface of the trough 61 an upstanding vertical cylindrical sleeve 62 fixed and sealed therein and coaxially aligned with the nozzle device 10 to receive the stream 23. In lieu of the cup 64 of FIG. 4, this embodiment has an inverted U-shape pipe 76 of a diameter greater than the jet stream and having a first downwardly opening leg aligned coaxially with the sleeve 62 to receive the jet stream which passes up and around the base of the "U" and out the other leg into the trough 61. The first leg has a flared lower end 77 extending in all horizontal directions past the vertical sleeve 62. Any residual drops on the inside surface of the first leg of the U-shape pipe 76 after the stream 23 stops flowing merely flow down the inner lower face of the first leg where they drip off the lower edge of the flared leg portion 77 into the trough 61.

All of the redirected portions of streams 23 captured by the devices 60, 70, 70' and 75 of FIGS. 4B, 5, 6 and 7 are of lower energy and are kept by these devices from dropping back through the central entry apertures for streams 23 in sleeves or dams 62.

Figure 8:
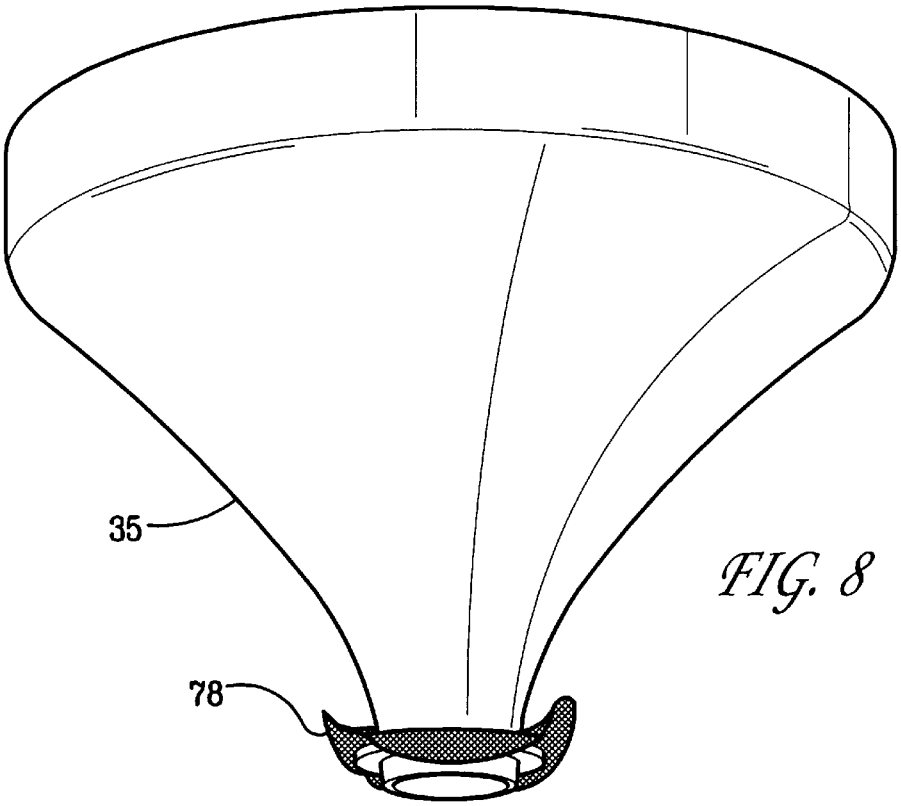
FIG. 8 is a side perspective view of a conical split stream diverter oriented generally as seen in FIG. 3B and showing a drip guide around the entrance opening of the diverter.
Figure 8A:
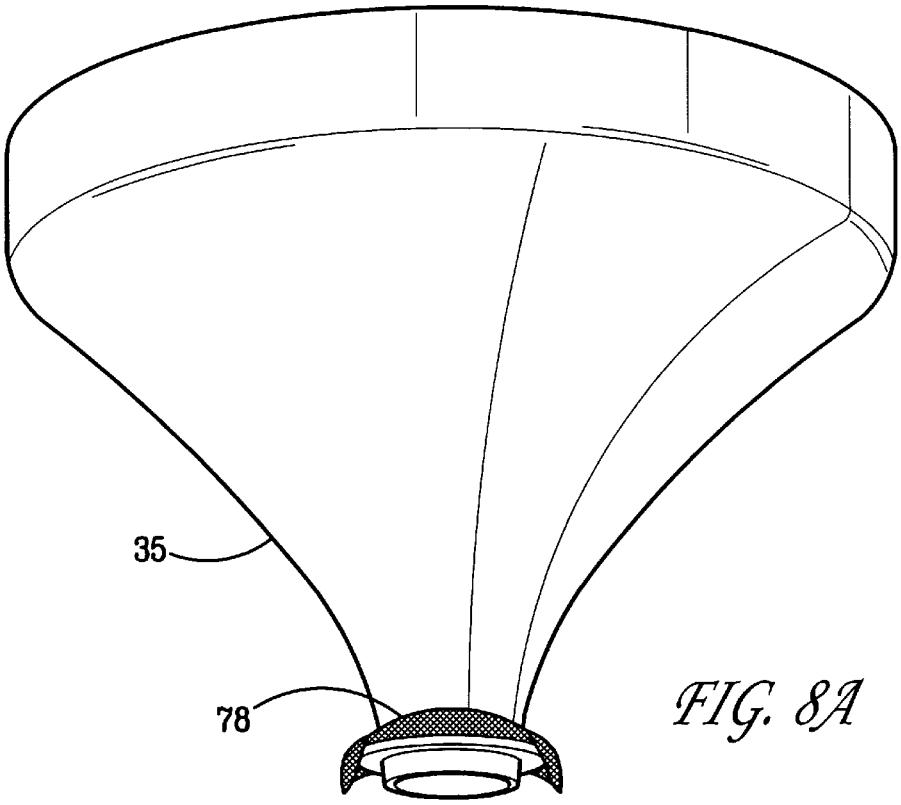
FIG. 8A is a side perspective view of the conical split stream diverter as seen perpendicular to FIG. 8 and showing the drip guide around the entrance end of the diverter.
Figure 9:
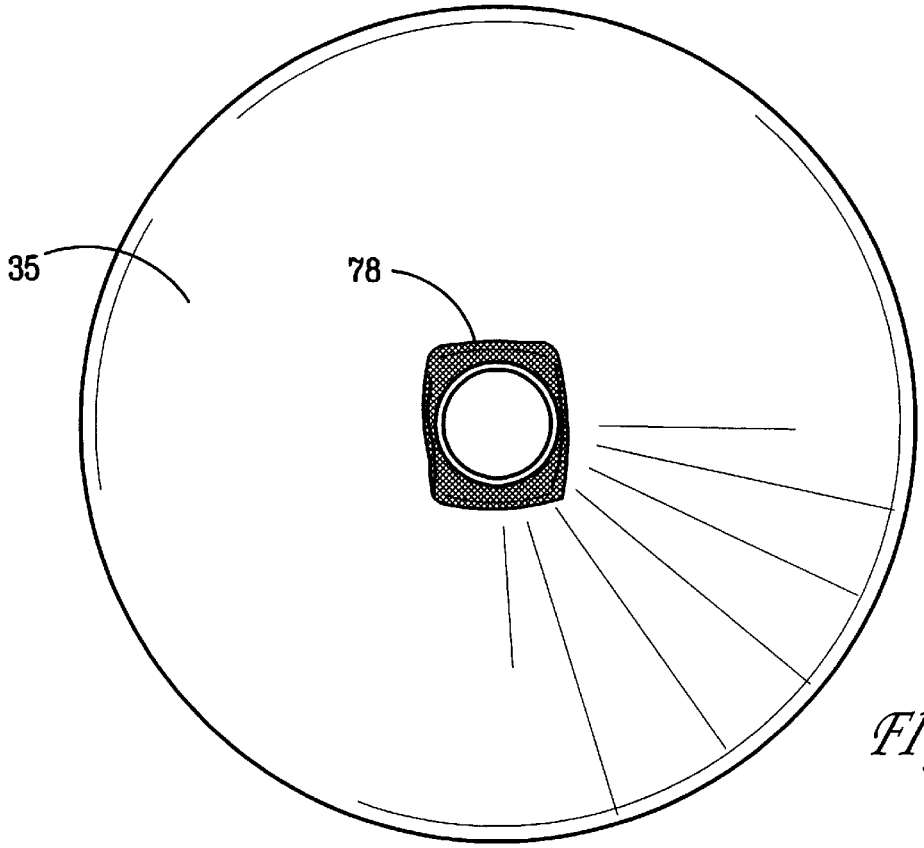
FIG. 9 is an axial underside view of the conical split stream diverter of FIG. 8A showing the drip guide encircling the diverter with its dripping periphery radially outwardly of the jet stream entrance.

The drip guide in FIGS. 8, 8A and 9 is an annular stainless steel screen member 78 that is bonded to an annular plastic PVC ring which is in turn bonded to the outer surface of the PVC diverter 35 around its entrance opening. The screen 78 is deformed like the brim of a cowboy hat. At the sides where the split streams 20A and 20B pass this drip guide, as seen in FIG. 3B, the screen edges are turned up to assure more clearance for the split streams. At 90° from these bent up sides the screen is turned down and provides lowest drip points outwardly beyond the opening in the diverter 35 through which the unsplit jet stream 23 passes. (See FIGS. 8, 8A and 9) FIG. 9 shows the screen from the underside. Water on the upturned screen portions flows around to the downwardly bent sides. The screen 78 not only is adjustable for optimum shape, but also is of 16 mesh which because of surface tension of water does not permit low energy droplets to pass through the screen.

Figure 10:
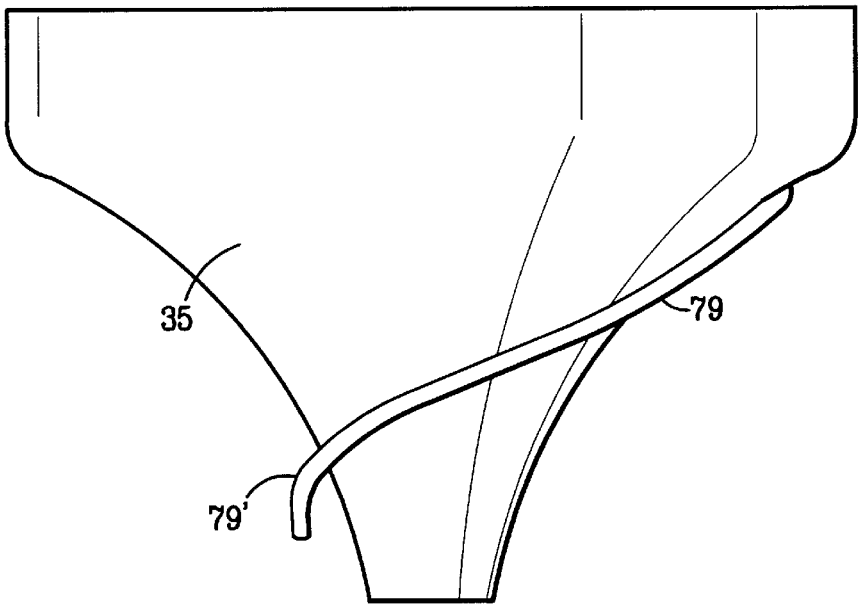
FIG. 10 is a view of an alternative embodiment to the conical split stream diverter as seen in FIG. 8A and showing a drip guide ridge on one side of the diverter with drip ends offset horizontally relative to the stream entrance opening of the diverter.
Figure 11:
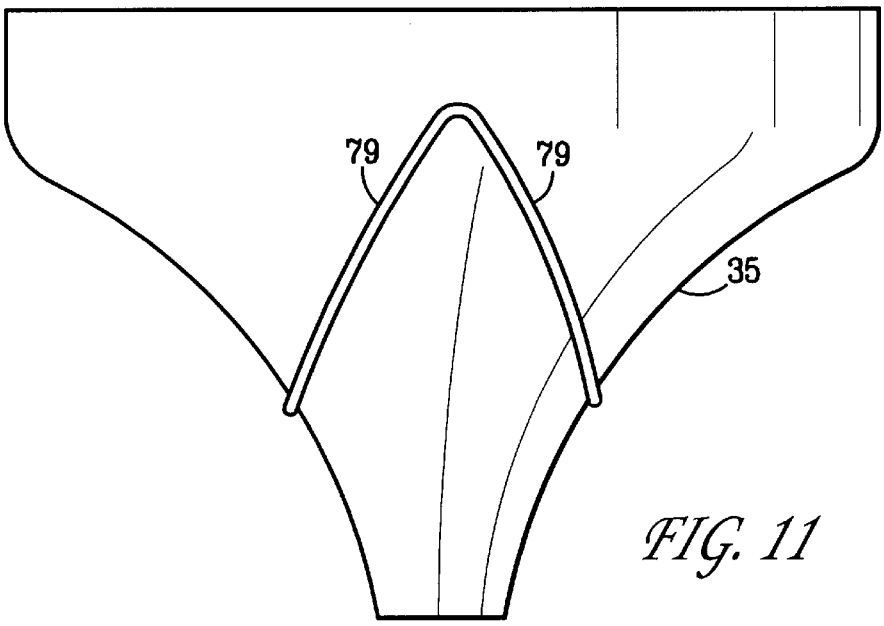
FIG. 11 is a view of a conical split stream diverter of FIG. 10 as seen perpendicular to FIG. 10 and showing drip guide ridges on both sides of the diverter.
Figure 12:
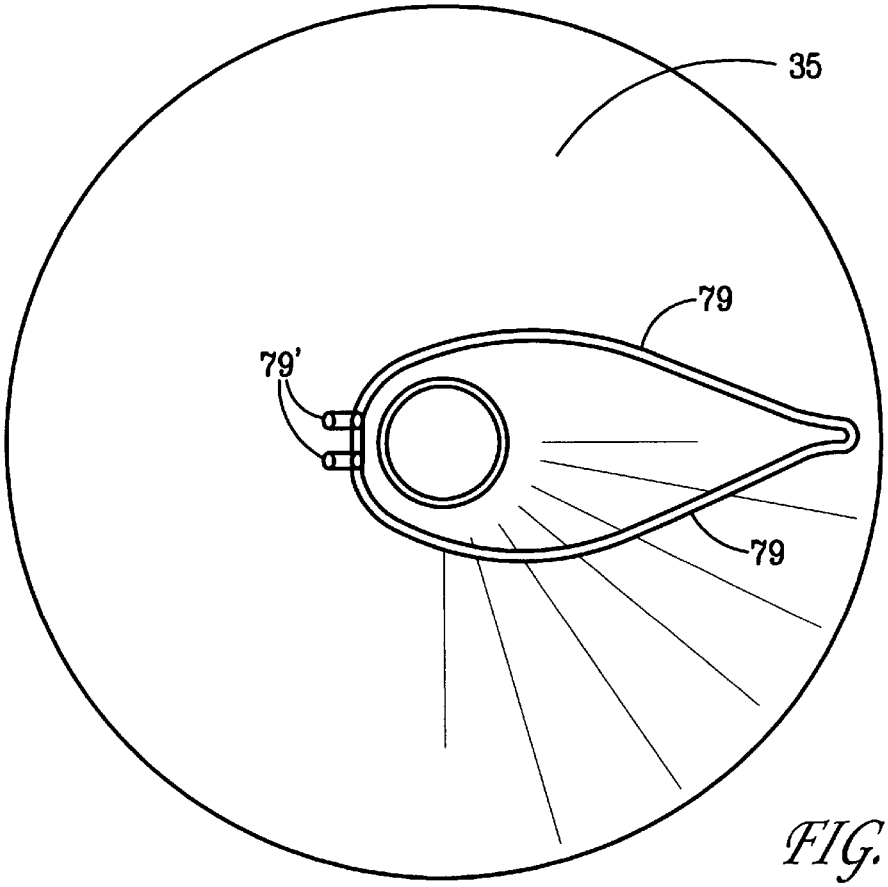
FIG. 12 is an axial underside view of the conical split stream diverter of FIGS. 9–10 showing the drip guide encircling the diverter with its dripping or droplet guiding surfaces radially outwardly of and at opposite sides of the jet stream entrance.

The drip guide of FIGS. 10–12 is a bead 79 of PVC plastic bonded to the surface of the PVC diverter 35 to form a raised rib with drip projections 79' at the lowest point to prevent low energy droplets from moving down the conical surface of the diverter toward the entry opening for the stream 23.

Figure 13:
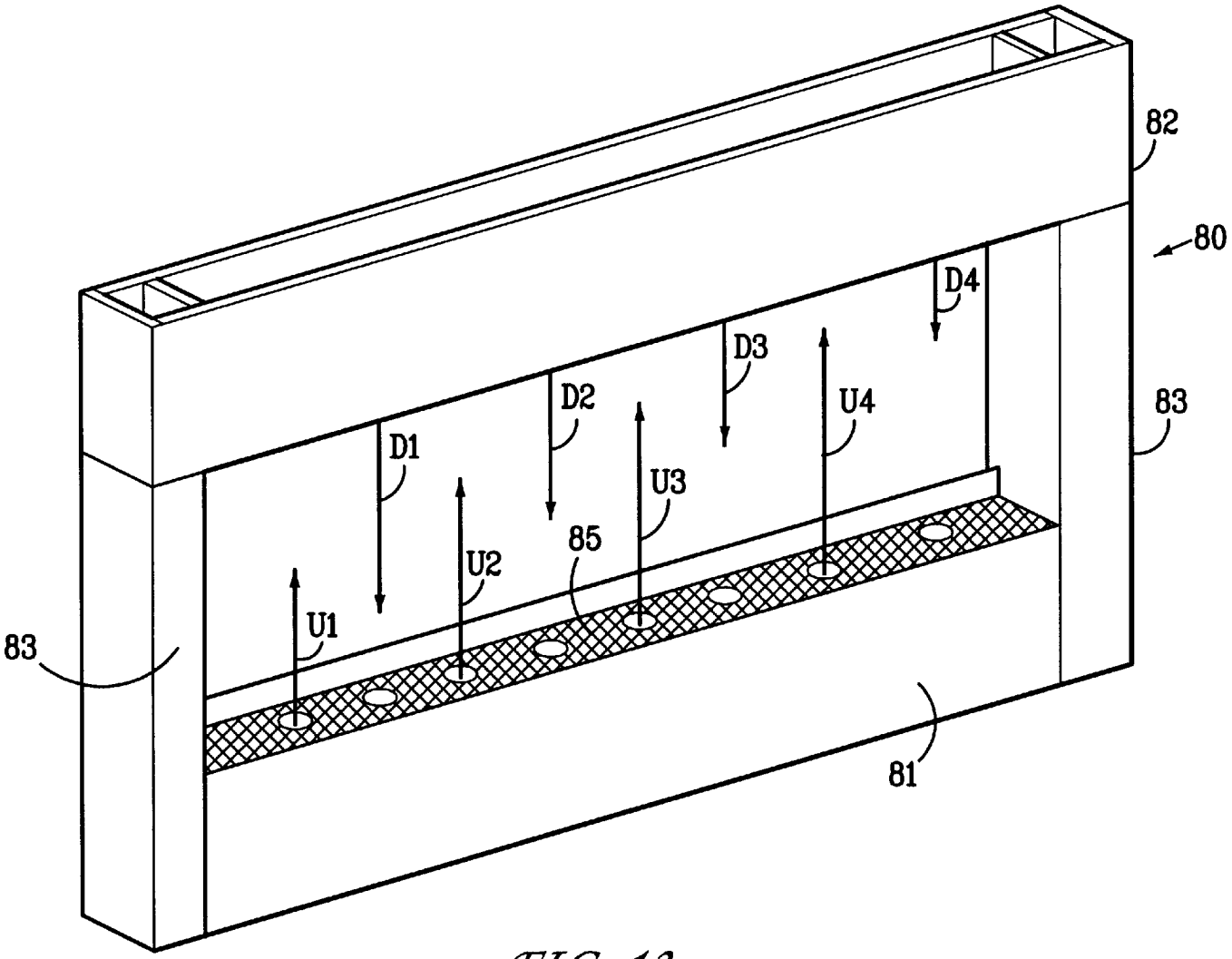
FIG. 13 is a perspective view of a jet stream display system using a plurality of jet stream nozzles and jet stream capturing devices in accordance with the present invention for projecting multiple independent vertical interruptable jet streams projected both upwardly and downwardly.

FIG. 13 shows a structure of multiple laminar flow liquid stream nozzle devices having at least two banks of oppositely located spaced receptacles with essentially linear laminar flow stream patterns each projected unidirectionally from a nozzle device in one receptacle to a stream receiver in another receptacle.

FIG. 13 illustrates an eye-catching display system structure 80 having a supporting framework including a lower tank 81, an upper trough or tank 82 and two hollow supporting column structures 83 for supporting the tank 82 directly over tank 81. Within tank 81 there are four nozzles like nozzle 10 of FIGS. 3, 3B and 4A using the shield 40', with their axes vertical for upwardly projecting the vertical laminar flow jet streams U1, U2, U3 and U4. These streams are projected through holes in a decorative grid 85 from nozzles hidden below the grid 85 and anchored in the bottom of tank 81. The upwardly projected laminar flow streams U1, U2, U3 and U4 are diverted and captured within tank 82 by catching, diverting and restraining devices such as seen in FIGS. 4B and 5–7. Within tank 82 are four inverted nozzles for vertically downwardly projecting the laminar flow jet streams D1, D2, D3 and D4. These nozzles are also like nozzle 10 of FIG. 3 and are rigidly supported in tank 82 to project the streams D1–D4 down through vertical sleeves (like sleeves 62 of FIGS. 4–7) sealed in the bottom of the tank 82. These inverted nozzles can be mounted by sliding the outlet sleeve 29 over a sleeve (like sleeve 62 in trough 61 of FIG. 4B) in the bottom of the tank 82.

Other variations within the scope of this invention will be apparent from the described embodiment and it is intended that the present descriptions be illustrative of the inventive features encompassed by the appended claims.

What is claimed is:

1. A stream generating device for projecting a vertical laminar flow liquid stream comprising a canister having a liquid inlet port for connection of the device to a source of liquid at a uniform pressure and flow rate, said canister having a stream defining port, means within the canister for eliminating turbulence in liquid flowing under uniform pressure and flow rate from said source through said canister between said inlet port and said stream defining port, said stream defining port being round and having a sharp edge to form a laminar flow stream of said liquid projected continuously from said stream defining port, said device having means defining an outlet port aligned along a common axis with said stream defining port to pass said laminar flow liquid stream for projection along said axis beyond said device, diverting means between said stream defining port and said outlet port for selectively diverting said liquid stream within the device to prevent any of the liquid in said laminar flow liquid stream from passing through said outlet port, said device being oriented with said axis essentially vertical with the stream projected upwardly, a catching chamber having means defining a downwardly facing aperture to receive the upwardly directed liquid stream, diverter means within said chamber for redirecting the stream along a path within the chamber to prevent any liquid from the stream from falling back along the path of the stream between said downwardly facing aperture and said outlet port, and means for returning redirected liquid from said chamber to said liquid source.

2. A stream generating device according to claim 1 wherein the diverter means is an inverted cup having peripheral walls for guiding the redirected liquid away from said downwardly facing aperture.

3. A stream generating device according to claim 1 wherein the diverter means is an inclined plate with a lower surface for guiding the redirected liquid away from said downwardly facing aperture and having a lower drip edge located horizontally beyond the downwardly facing aperture.

4. A stream generating device according to claim 1 wherein the diverter means is an inclined plate with a lower concave surface for guiding the redirected liquid away from said downwardly facing aperture and having a lower drip edge located horizontally beyond the downwardly facing aperture.

5. A stream generating device according to claim 1 wherein the diverter means is a scoop member with a curved surface for guiding the redirected liquid away from said downwardly facing aperture and having all lower drip edges located horizontally beyond the downwardly facing aperture.

6. A stream generating device according to claim 1 wherein the diverter means is a conduit with a downwardly facing flared inlet end for receiving said laminar flow stream and having a discharge end for guiding the redirected liquid away from said downwardly facing aperture, said flared inlet end having a lower peripheral drip edge located horizontally outside the downwardly facing aperture.

7. A jet stream device for projecting a laminar flow water jet stream comprising a canister having a water inlet port for connection of the device to a source of water at a uniform pressure and flow rate, said canister having a water jet steam defining port, means within the canister for eliminating turbulence in water flowing under uniform pressure and flow rate from said source through said canister between said inlet port and said jet stream defining port, said jet stream defining port being round and having a sharp edge to form a laminar flow jet stream of said flowing water projected continuously from said jet stream defining port, said device having means defining an outlet port aligned along a common axis with said jet stream defining port to pass said laminar flow water jet stream for projection along said axis beyond said device, diverting means between said jet stream defining port and said outlet port for selectively diverting said water jet stream within the device to prevent any of the water in said laminar flow jet stream from passing through said outlet port, said diverting means comprising means selectively activated to split said laminar flow jet stream into two divergent streams to pass on opposite sides of said outlet port, collecting means for collecting the water from said divergent streams for return to said water source, said outlet port defining means having curved progressively increasingly separated divergent outer surfaces to be engaged by said divergent streams after passing on opposite sides of said outlet port for smoothly guiding said divergent streams outwardly with respect to said axis and into said collecting means.

8. A jet stream device according to claim 7 wherein the means defining said outlet port is a flared cone.

9. A jet stream device according to claim 7 wherein the means defining said outlet port is made of polyvinyl chloride.

10. A jet stream device according to claim 7 wherein the means defining said outlet port is a cone having on its outer surface drip guide means to prevent water drops on said outer surface from dropping into the path of and disturbing the normal flow of the laminar flow jet streams from said stream defining port to said outlet port.

11. A jet stream device according to claim 10 wherein the drip guide means comprises raised ribs on opposite sides of the cone.

12. A jet stream device according to claim 10 wherein the drip guide means is an annular screen member encircling the outlet port.

13. A structure of multiple laminar flow liquid stream nozzle devices having at least two banks of oppositely located spaced receptacles with essentially linear laminar flow stream patterns each projected unidirectionally from a nozzle device in one receptacle to a stream receiver in another receptacle.

14. A structure according to claim 13 comprising multiple liquid stream nozzle devices projecting vertical parallel streams between a lower bank and an upper bank.

15. A structure according to claim 13 wherein each bank includes a tank for capturing spent water at the respective bank.

16. A structure according to claim, 15 including means for liquid transfer between said tanks and pump means in only one tank for providing pressurized liquid to all nozzle devices.

17. A structure according to claim 16 including means for moving all spent water from each nozzle device to said one tank having said pump means.

18. A structure according to claim 13 wherein each bank has stream projecting nozzles.

19. A structure according to claim 13 wherein one bank has nozzle devices projecting jet streams vertically upwardly.

20. A structure according to claim 13 wherein one bank has all its nozzle devices projecting jet streams vertically upwardly.

21. A capturing receiver for a relatively non-divergent essentially unidirectional vertically upwardly directed liquid stream, said receiver including a catching chamber having means defining a downwardly facing aperture to receive the upwardly directed stream, diverter means within said chamber for redirecting the stream along a path away from the aperture, and including means providing a flow path for redirected low energy liquid within the chamber which directs such low energy liquid away from the aperture.

* * * * *